US007248201B2

(12) United States Patent
Buccinna et al.

(10) Patent No.: US 7,248,201 B2
(45) Date of Patent: Jul. 24, 2007

(54) KEY FOB WITH AUTOMATIC COVER RELEASE

(75) Inventors: Frank Buccinna, Livonia, MI (US); Peter Kowtun, Plymouth, MI (US); John Burca, Rochester Hills, MI (US)

(73) Assignee: War Corporation, Southfield, MI (US)

( * ) Notice: Subject to any disclaimer, the term of this patent is extended or adjusted under 35 U.S.C. 154(b) by 190 days.

(21) Appl. No.: 11/074,094

(22) Filed: Mar. 7, 2005

(65) Prior Publication Data

US 2006/0202881 A1 Sep. 14, 2006

(51) Int. Cl.
*G08C 19/12* (2006.01)

(52) U.S. Cl. ..... 341/176; 361/680; 361/683; 455/556.1; 455/575.4; 341/22

(58) Field of Classification Search ..... 455/556.1, 455/575.4; 701/36; 361/680, 683; 341/22, 341/176

See application file for complete search history.

(56) References Cited

U.S. PATENT DOCUMENTS 5,388,691 A 2/1995 White
5,541,571 A 7/1996 Ochs et al.
6,707,664 B2 * 3/2004 Murphy ..... 361/680
6,718,240 B1 * 4/2004 Suda et al. ..... 701/36
6,744,624 B2 * 6/2004 Siddiqui ..... 361/683
6,786,332 B1 9/2004 Patrick et al.
7,006,015 B2 * 2/2006 England ..... 341/22
2004/0183671 A1 9/2004 Long
2004/0198437 A1 * 10/2004 Yamamoto et al. ..... 455/556.1
2005/0012594 A1 1/2005 Shim
2005/0215298 A1 * 9/2005 Lee ..... 455/575.4

* cited by examiner

*Primary Examiner*—Albert K. Wong
(74) *Attorney, Agent, or Firm*—MacMillan, Sobanski & Todd, LLC

(57) ABSTRACT

A key fob for use in a remote keyless entry system of a vehicle includes a transmitter housing having at least one user operable button thereon indicative of remote keyless entry functions associated with the vehicle for transmitting function requests when the user operable buttons are depressed. A cover is retained on the transmitter housing and is slidably movable between an open position exposing the buttons and a closed position wherein the buttons are covered by the cover. Compression springs are coupled between the transmitter housing and the cover such that the springs urge the cover toward the open position, while a catch mechanism selectively and releasably secures the cover in the closed position against the bias of the springs.

20 Claims, 3 Drawing Sheets

KEY FOB WITH AUTOMATIC COVER RELEASE

BACKGROUND OF INVENTION

The present invention relates to remote keyless entry systems for vehicles, and in particular to a key fob of a remote keyless entry system.

Remote keyless entry (RKE) systems for vehicles enjoy wide use today, with RKE systems adding additional functions over and above the more conventional lock/unlock, trunk release and alarm functions. Such functions may include, for example, power door open/close and remote engine start. Typically, the conventional key fob transmits a vehicle function request whenever a button is pressed, whether inadvertent or not.

In addition, some RKE systems employ a passive key fob where certain vehicle functions are performed based on, for example, the proximity and direction of movement of the key fob relative to the vehicle, rather than only reacting to the actuation of a button. While most functions are performed on these passive devices without the need to press a button, there may be buttons on them for the infrequent occasion when the user wishes to activate a vehicle function outside of the normal passive activation parameters. But again, inadvertent pressing of a button can cause a vehicle function to be performed even when the operator does not wish it to be.

For some, a RKE function being performed when a button is inadvertently pressed is a significant annoyance. For example, when a key fob is in ones pocket or purse, an alarm or trunk release button may be inadvertently pressed, causing the key fob to transmit the requested vehicle function even if not desired by the one carrying the key fob. One may then have to pull out the key fob and press the button again or go over to the vehicle to counteract the inadvertent vehicle function performed.

Thus, it is desirable to provide a way to limit the potential for inadvertently actuating the buttons on a key fob while still allowing for quick and easy access to the buttons when desired by the user.

SUMMARY OF THE INVENTION

An embodiment of the present invention contemplates a key fob for use in a remote keyless entry system of a vehicle. The key fob may include a transmitter housing having one or more user operable buttons thereon indicative of a remote keyless entry function associated with the vehicle for transmitting a function request when the user operable button is depressed. The key fob may also include a cover retained on the transmitter housing and slidably movable between an open position exposing the one or more buttons and a closed position wherein the one or more buttons are covered by the cover. A biaser is coupled between the transmitter housing and the cover such that the biaser urges the cover toward the open position, and a catch mechanism selectively and releasably secures the cover in the closed position against the bias of the biaser.

An advantage of an embodiment of the present invention is that the key fob includes a cover for protecting user operable buttons from inadvertent actuation, while also providing a simple, convenient, automatic cover release for quick and easy access to the buttons when desired.

A further advantage of an embodiment of the present invention is that the quick and easy access to the user operable buttons on the key fob are provided while still retaining the cover to the transmitter housing at all times, thus avoiding the potential for the cover to become separated from the housing and lost. Moreover, once the user no longer needs access to the buttons, the cover is easily moved to and retained in its closed position until the next time the user wishes to access the buttons.

An additional advantage of an embodiment of the present invention is that the catch mechanism, for holding the cover in its closed position, the automatic release, for biasing the cover to its open position, and the stop, for retaining the cover to the housing, are all relatively inexpensive to fabricate and assemble, thus minimizing the cost of the key fob.

DETAILED DESCRIPTION

Figure 1:
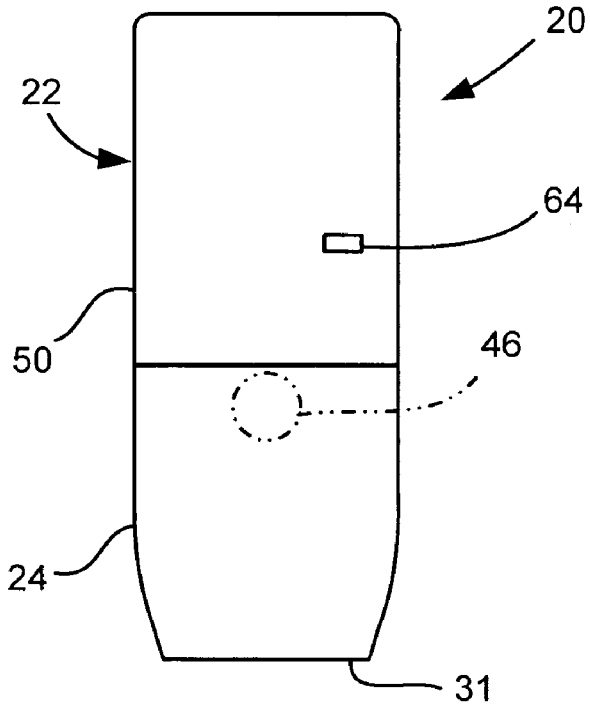
FIG. 1 is a schematic front view of a key fob, with a cover shown in a closed position, in accordance with an embodiment of the present invention.
Figure 2:
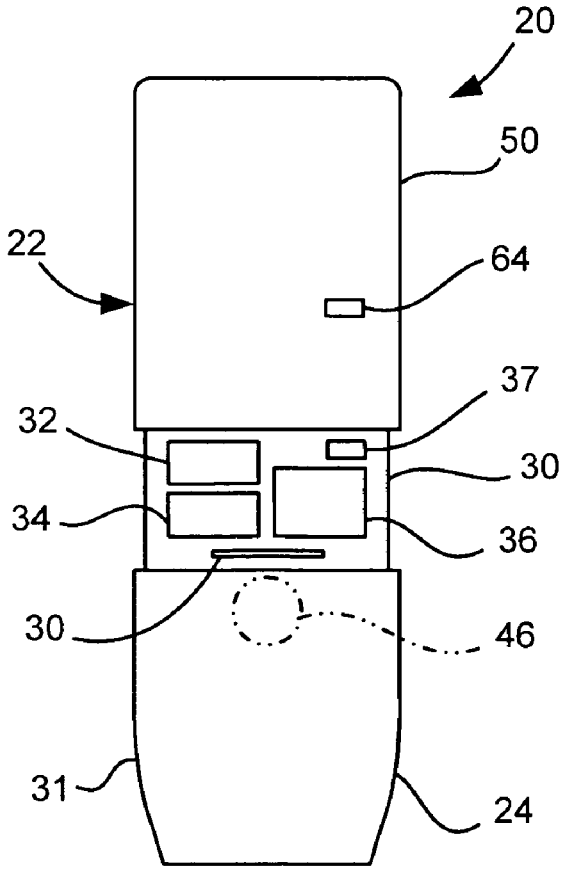
FIG. 2 is a schematic front view similar to FIG. 1, but with the cover shown in its open position.
Figure 3:
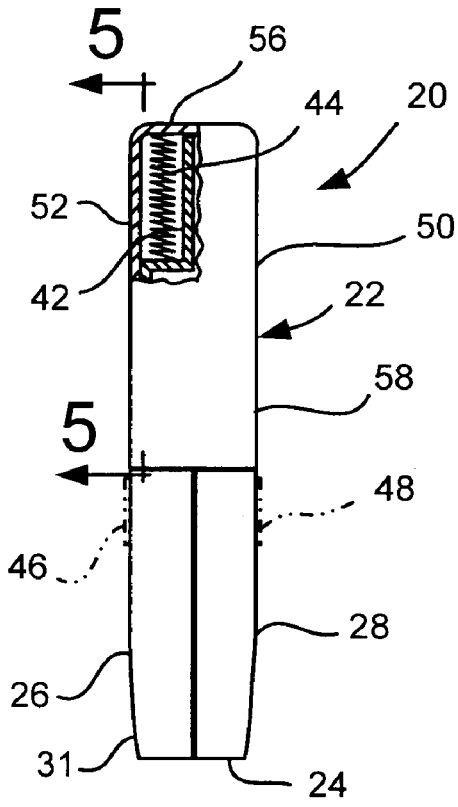
FIG. 3 is a schematic, partial section, side view of the key fob of FIG. 1.
Figure 4:
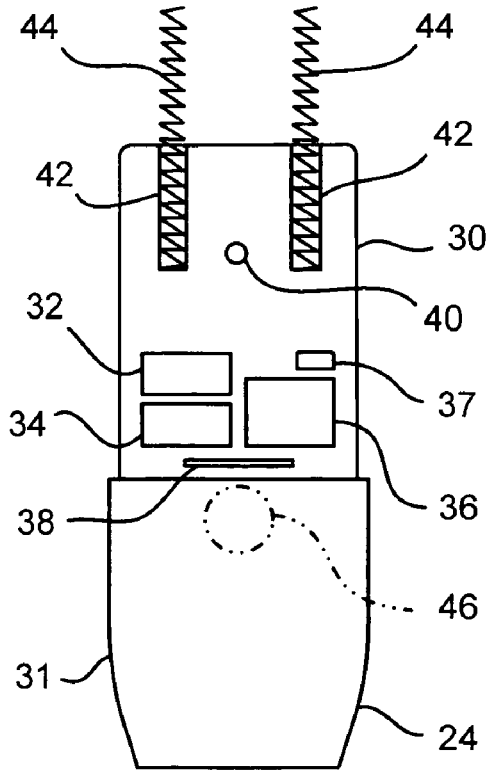
FIG. 4 is a schematic front view similar to FIG. 1, but with the cover not shown.
Figure 5:
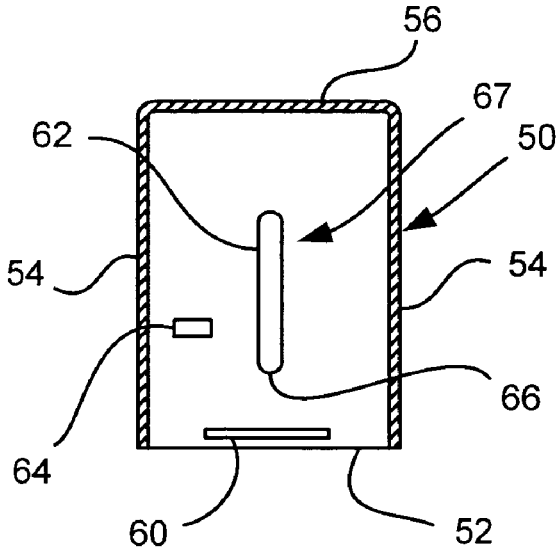
FIG. 5 is a cross section view of the cover, taken along line 5-5 in FIG. 3.

FIGS. 1-5 illustrate a portion of a remote keyless entry (RKE) system, indicated generally at 20, employed with a vehicle (not shown). A base or vehicle mounted portion (not shown) of the RKE system 20 may include a receiver or transceiver (not shown) and a controller (not shown) that may be comprised of various combinations of hardware and software, as is known to those skilled in the art. The controller may be in communication with systems that carry out the desired RKE functions, such as a door lock/unlock actuator (not shown), a vehicle horn and headlights (not shown), an engine ignition system (not shown), a door actuator (not shown) and/or a trunk release mechanism (not shown). These systems will not be described in any detail since they are known to those skilled in the art.

The RKE system 20 also includes a key fob 22. The term "key fob" as used herein includes both a conventional key fob—where a signal is only transmitted to the vehicle when a button is pressed—as well as a passive remote keyless entry, remote start, keyless ignition, etc. type transmitter (also called passive remote function actuator)—where certain functions may be performed without any user input based on, for example, the proximity and motion of the device relative to the vehicle. For the latter type of key fob this invention may be particularly advantageous since the user buttons on the key fob may be rarely used.

The key fob 22 has a transmitter housing 24. Within the transmitter housing 24, the key fob 22 may include a fob controller (not shown), powered by a battery (not shown), and a transmitter (not shown), capable of transmitting a radio frequency (RF) signal that can be received by the receiver in the vehicle. The transmitter of course may be a transceiver if the RKE system 20 includes two-way communication, and may transmit the signal by wireless means other than by RF transmission, if so desired. The details of the fob controller, transmitter and other electronic circuitry of the key fob 22 will not be discussed in detail herein since they are known to those skilled in the art.

The transmitter housing 24 has a front side 26 and a back side 28, and also has a recessed portion 30 that has smaller dimensions than a main portion 31. On the front side 26 of the main portion 31 is a first user release location 46, with the general size and position shown in phantom in FIGS. 1-4. On the back side 28 of the main portion 31 is a second user release location 48, with the general size and position shown in phantom in FIG. 3. The user release locations 46, 48 are located generally in the middle of the front and back sides 26, 28, respectively, and adjacent to the recessed portion 30.

On the front side 26, in the recessed portion 30 of the housing 24, first 32, second 34, and third 36 user operable buttons are located. The vehicle functions associated with these buttons 32, 34, 36, may include, for example, door lock, door unlock, trunk release, engine start, door open, door close, alarm, etc. as is desired for the particular vehicle and RKE system 20. The operation of these vehicle functions will not be discussed as they are known to those skilled in the art. This recessed portion 30 may also have a light emitting diode (LED) 37 located therein that may be activated, for example, to indicate a particular function is being performed, to indicate a low battery condition, etc.

Also located in and extending outward from the recessed portion 30 of the housing 24 are a lock rib 38 and a stop pin 40. The lock rib 38 extends widthwise across the recessed portion 30 adjacent to the main portion 31 of the housing 24. The stop pin 40 is positioned so that it will be located under and in contact with a cover 50, whether the cover 50 is in its closed or open position. The recessed portion 30 of the housing 24 also includes a pair of spring retention recesses 42, within which are mounted a pair of compression springs 44. While two springs 44 are illustrated, the key fob 22 may incorporate only one spring 44 and one spring retention recess 42 instead, if so desired. Also, other means of providing a biasing force similar to the springs may be employed instead of the springs, if so desired.

The cover 50 of the key fob 22 fits over and is slidable relative to the transmitter housing 24. The cover 50 has a front wall 52, which extends across the front side 26 of the recessed portion 30, a pair of side walls 54 and a back wall 58, which help to maintain the orientation of the cover 50 when sliding between the open and closed position, and an end wall 56, which is in surface contact with the springs 44.

The front wall 52 of the cover 50 includes a lock catch 60 and a stop slot 62, and may include a LED viewing window 64. The lock catch 60 is a recess in the front wall 52 that is sized slightly longer and slightly wider than the lock rib 38, and is located so that it aligns with the lock rib 38 when the cover 50 is in its closed position. The lock rib 38 extends outward sufficiently from the front side 26 of the recessed portion 30 that it will extend into the lock catch 60 when the two are aligned. Accordingly, with the lock rib 38 engaged in the lock catch 60, the cover 50 can be held closed against the bias of the springs 44.

The stop slot 62 is a recess in the front wall 52 that has a width about the diameter of the stop pin 40 and a length that is at least as long as the diameter of the stop pin 40 plus the distance traveled by the cover 50 between its closed and open positions. The stop slot 62 includes a stop end 66 that is located to engage with the stop pin 40 when the cover 50 is in its open position. Thus, the engagement of the stop pin 40 with the stop end 66 of the stop slot 62 acts as a travel limiter 67, preventing the cover 50 from being pushed all of the way off the end of the housing 24 by the springs 44. As an alternative, the stop pin may be located on and extending from the cover while the stop slot is located on the housing.

The LED viewing window 64 is located to align with the LED when the cover 50 is in the closed position and may be just a hole through the front wall 52 or may also include a transparent material covering the hole. Thus, even though the buttons 32, 34, 36 are covered when the cover 50 is in its closed position, the user of the key fob 22 can still see when the LED is lit.

While the lock catch 60 and stop slot 62 are illustrated as slots recessed in the cover front wall 52, either or both may instead be formed from flanges extending outwardly from the cover front wall 52 that partially or fully surround the lock rib 38 and stop pin 40, respectively. Also, while the cover 50 is shown completely wrapping around the front and back sides 26, 28 of the housing 24, it may also wrap only partially around the back 28, if so desired. And, while the cover 50 is shown sliding over the recessed portion 30 of the housing 24 in order to provide a smooth surface when closed, the housing 24 may be the same size along its length (i.e., no recess) with the cover 50 being larger and sticking out somewhat from the housing 24.

The operation of the key fob 22 will now be described. In operation, when the user desires to access the user operable buttons 32, 34, 36, the user merely squeezes on the front and back sides 26, 28 of the transmitter housing 24 in proximity to the edge of the cover 50 near the center of each side 26, 28. That is, the transmitter housing 24 is squeezed at about the first and second user release locations 46, 48. There is a gap (not shown) between the front side 26 and back side 28 so, when squeezed, the front side 26 will flex. This flexing will cause the lock rib 38 to release from the lock catch 60, thus allowing the compression springs 44 to automatically slide the cover 50 from its closed to its open position. The stop pin 40 will hit the stop end 66 of the stop slot 62, thus preventing the springs 44 from shooting the cover 50 all of the way off the end of the housing 24. With the cover 50 in its open position, the user has full access to all of the user operable buttons 32, 34, 36.

After the user is done using the buttons 32, 34, 36, he merely slides the cover 50 against the bias of the springs 44 back into its closed position where the lock catch 60 will automatically engage the lock rib 38 and hold the cover 50 in its closed position against the bias of the springs 44. Preferably, the lock rib 38 is sized and located relative to the lock catch 60 so that it will snap into the lock catch 60 sufficient to cause audible and tactile feedback for the user to confirm that the cover 50 is locked in its closed position. With the cover 50 now in its closed position, the buttons 32, 34, 36 cannot be inadvertently actuated by the user.

Figure 6:
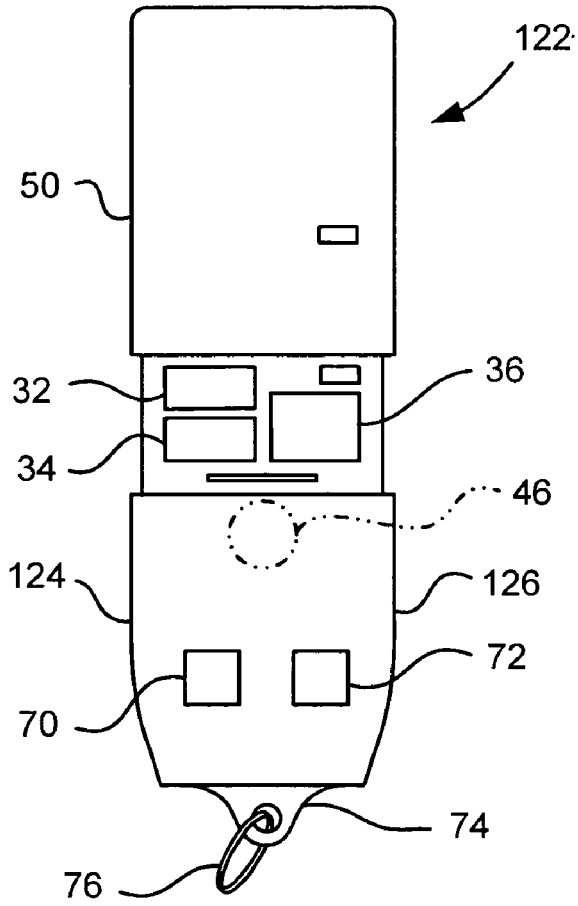
FIG. 6 is a schematic front view similar to FIG. 2, but illustrating a second embodiment of the present invention.

FIG. 6 illustrates a second embodiment of the present invention. Since this embodiment is similar to the first, elements in this embodiment that are the same as elements in the first embodiment will be identified with the same element numbers, while elements that have changed and new elements will be identified with unique element numbers. The key fob 122 may include additional user operable buttons 70, 72 that are exposed at all times on front side 126 of the transmitter housing 124, while only buttons 32, 34, 36 having certain features that are particularly undesirable to inadvertently actuate or buttons having features that are seldom used would be hidden by the cover 50. In this way, the most used buttons 70, 72 are readily available to the operator, while the other buttons 32, 34, 36 can quickly and easily become accessible by releasing the automatically opening cover 20. This embodiment also illustrates that the key fob 122 may include other common features associated with conventional key fobs without interfering with the automatically opening cover 50. For example, the key fob 122 may have an attachment flange 74 to which a key ring 76 is mounted. These additional features are also applicable to the key fob of the first embodiment. In other respects, including the opening and closing of the cover 50, the key fob 122 of this embodiment can be the same as the key fob 22 of the first embodiment, and so will not be described in any more detail.

While certain embodiments of the present invention have been described in detail, those familiar with the art to which this invention relates will recognize various alternative designs and embodiments for practicing the invention as defined by the following claims.

What is claimed is:

1. A key fob for use in a remote keyless entry system of a vehicle, the key fob comprising:

a transmitter housing having a user operable button thereon indicative of a remote keyless entry function associated with the vehicle for transmitting a function request when the user operable button is depressed, the transmitter housing having a front side including a first user release location and an opposed back side including a second user release location;

a cover retained on the transmitter housing and slidably movable between an open position exposing the user operable button and a closed position wherein the user operable button is covered by the cover, the cover including a lock catch;

a biaser coupled between the transmitter housing and the cover such that the biaser urges the cover toward the open position; and a catch mechanism selectively and releasably securing the cover in the closed position against the bias of the biaser, the catch mechanism including a lock rib extending from the transmitter housing, with the lock catch located to be selectively lock rib when the cover is in the closed position, and wherein the first user release location is located adjacent to the lock rib, with the first user release location flexible such that, upon applying pressure to the first and second user release locations the lock rib will disengage from the lock catch.

2. The key fob of claim 1 further including a travel limiter that has a stop slot with a stop end, located on a one of the cover and the transmitter housing and a stop pin located on an other of the cover and the transmitter housing, with the stop pin extending within and being slidable relative to the stop slot, and with the stop end engaging the stop pin against the bias of the biaser when the cover is in the open position.

3. The key fob of claim 1 wherein the transmitter housing includes a spring retention recess and the biaser is a compression spring mounted in the retention recess and extending between the transmitter housing and the cover.

4. The key fob of claim 1 wherein the transmitter housing includes a pair of spring retention recesses and the biaser is a pair of compression springs, each mounted in a respective one of the pair of spring retention recesses, end each of the compression springs extends between the transmitter housing end the cover.

5. The key fob of claim 1 wherein the transmitter housing includes a second user operable button thereon located adjacent to the user operable button such that the second user operable button is covered by the cover in the closed position and exposed when the cover is in the open position.

6. The key fob of claim 1 wherein the transmitter housing includes a second user operable buff on thereon spaced from the user operable button such that the second user operable button is exposed both when the cover is in the closed position and in the open position.

7. The key fob of claim 1 wherein the transmitter housing includes a LED located adjacent to the user operable button such that the LED is covered by the cover in the closed position and exposed when the cover is in the open position, and the cover includes a viewing window that is aligned with the LED when the cover is in the closed position.

8. The key fob of claim 1 wherein the transmitter housing includes an attachment flange extending therefrom, and a key ring mounted to the attachment flange.

9. A key fob for use in a remote keyless entry system of a vehicle, the key fob comprising:

a transmitter housing having a user operable button thereon indicative of a remote keyless entry function associated with the vehicle for transmitting a function request when the user operable button is depressed, the transmitter housing including a LED located adjacent to the user operable button;

a cover retained on the transmitter housing and slidably movable between an open position exposing the user operable button and a closed position wherein the user operable button is covered by the cover, the cover including a viewing window mat is aligned with the LED when the cover is in the closed position, and wherein the LED is located such that the LED is covered by the cover in the closed position and exposed when the cover is in the open position;

a biaser coupled between the transmitter housing and the cover such that the biaser urges the cover toward the open position; and a catch mechanism selectively and releasably securing the cover in the closed position against the bias of the biaser.

10. The key fob of claim 9 wherein the catch mechanism includes a lock rib extending from the transmitter housing and a lock catch on the cover, with the lock catch located to be selectively engage able with the lock rib when the cover is in the closed position.

11. The key fob of claim 10 wherein the transmitter housing has a front side including a user release location located adjacent to the lock rib, with the user release location flexible such that, upon applying pressure thereto, the lock rib will disengage from the lock catch.

12. The key fob of claim 9 further including a travel limiter that has a stop slot, with a stop end, located on a one of the cover and the transmitter housing and a stop pin located on an other of the cover and the transmitter housing, with the stop pin extending within and being slidable relative to the stop slot and with the stop end engaging the stop pin against the bias of the biaser when the cover is in the open position.

13. The key fob of claim 9 wherein the transmitter housing includes a second user operable button thereon spaced from the user operable button such that the second user operable button is exposed both when the cover is in the closed position and in the open position.

14. The key fob of claim 9 wherein the transmitter housing includes an attachment flange extending therefrom, and a key ring mounted to the attachment flange.

15. A key fob for use in a remote keyless entry system of a vehicle, the key fob comprising:

a transmitter housing having a user operable button thereon indicative of a remote keyless entry function associated with the vehicle for transmitting a function request when the user operable button is depressed, and a spring retention recess, the transmitter housing including a LED located adjacent to the user operable button;

a cover retained on the transmitter housing and slidably movable between an open position exposing the user operable button and a closed position wherein the user operable button is covered by the cover, the cover including a viewing window that is aligned with the LED when the cover is in the closed position, and wherein the LED is located such that the LED is covered by the cover in the closed position and exposed when the cover is in the open position;

a compression spring mounted In the retention recess and extending between the transmitter housing and the cover such that the compression spring urges the cover toward the open position; and a catch mechanism selectively and releasably securing the cover in the closed position against the bias of the compression spring.

16. The key fob of claim 15 wherein the transmitter housing includes a second spring retention recess and a second compression spring is mounted in the second retention recess and extends between the transmitter housing and the cover such that the second compression spring urges the cover toward the open position.

17. The key fob of claim 15 wherein the catch mechanism includes a lock rib extending from the transmitter housing and a lock catch on the cover, with the lock catch located to be selectively engageable with the lock rib when the cover is in the closed position, and the transmitter housing has a front side including a user release location located adjacent to the lock rib, with the user release location flexible such that, upon applying pressure thereto, the lock rib will disengage from the lock catch.

18. The key fob of claim 15 further including a travel limiter that has a stop slot, with a stop end, located on a one of the cover and the transmitter housing and a stop pin located on an other of the cover and the transmitter housing, with the stop pin extending within and being slidable relative to the stop slot, and with the stop end engaging the stop pin against the bias of the compression spring when the cover is in the open position.

19. The key fob of claim 15 wherein the transmitter housing includes a second user operable button thereon spaced from the user operable button such that the second user operable button is exposed both when the cover is in the closed position and in the open position.

20. The key fob of claim 15 wherein the transmitter housing includes an attachment flange extending therefrom, and a key ring mounted to the attachment flange.

* * * * *

UNITED STATES PATENT AND TRADEMARK OFFICE

CERTIFICATE OF CORRECTION

PATENT NO. : 7,248,201 B2
APPLICATION NO. : 11/074094
DATED : July 24, 2007
INVENTOR(S) : Frank Buccinna, Peter Kowtun and John Burca It is certified that error appears in the above-identified patent and that said Letters Patent is hereby corrected as shown below:

Title Page item [73], Assignee Listing,

The Assignee listing, "War Corporation, Southfield, MI (US)" should read

-- Lear Corporation, Southfield, MI (US) --.

Signed and Sealed this

Sixteenth Day of October, 2007

JON W. DUDAS
*Director of the United States Patent and Trademark Office*